US006222430B1

(12) United States Patent
Horie et al.

(10) Patent No.: US 6,222,430 B1
(45) Date of Patent: Apr. 24, 2001

(54) DIELECTRIC FILTER

(75) Inventors: Kenichi Horie; Shoichi Iwaya, both of Tokyo (JP)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/316,775

(22) Filed: May 21, 1999

(30) Foreign Application Priority Data

May 29, 1998 (JP) ..... 10-166361

(51) Int. Cl.[7] ..... H01P 1/20; H01P 7/00

(52) U.S. Cl. ..... 333/204; 333/205; 333/219; 333/235

(58) Field of Search ..... 333/202, 204, 333/205, 219, 235

(56) References Cited

U.S. PATENT DOCUMENTS 5,396,201 * 3/1995 Ishizaki et al. ..... 333/204
6,020,799 * 2/2000 Ishizaki et al. ..... 333/204

FOREIGN PATENT DOCUMENTS

WO9619843 6/1996 (WO) ..... H01P/1/203
WO9805120 2/1998 (WO) ..... H03H/7/01

OTHER PUBLICATIONS

Patent Abstract of Japan, Publication No. 07312503A, Application No. 06195056, Date of Publication Nov. 28, 1995.

Patent Abstract of Japan, Publication No. 09214204A, Application No. 08016258, Date of Publication Aug. 15, 1997.

* cited by examiner

*Primary Examiner*—Robert Pascal
*Assistant Examiner*—Patricia T. Nguyen
(74) *Attorney, Agent, or Firm*—Dicran Halajian

(57) ABSTRACT

A dielectric filter includes a first dielectric layer containing at least a pair of strip-line resonators to be electromagnetically coupled to each other. Second and third dielectric layers are disposed in an opposed relation to each other with the first dielectric layer sandwiched therebetween and having substantially the same dielectric constant (K1). Each of the second and third dielectric layers contains at least one shield electrode. The dielectric filter further includes fourth and fifth dielectric layers which have substantially the same dielectric constant (K2) and are interposed between the first and second dielectric layers and between the first and third dielectric layers, respectively. The dielectric constant (K2) of the fourth and fifth dielectric layers is selected to be less than any one of the dielectric constant (K1) of the second and third dielectric layers and the dielectric constant (K3) of the first dielectric layer.

15 Claims, 3 Drawing Sheets

DIELECTRIC FILTER

BACKGROUD OF THE INVENTION

This invention relates to a dielectric filter suitable for use in high-frequency radio communication devices such as mobile phones and particularly to a miniature chip-type dielectric filter which is constructed by laminating a number of dielectric layers with electrodes sandwiched therebetween.

There is an increasing demand, in the field of mobile phones and other handy radio communication devices, for further miniaturized high frequency filters, while such filters are required to meet both a high frequency selectivity and a low insertion loss. There has been proposed as a high-frequency filter which can meet the above requirements a multilayer ceramic filter which comprises stripline electrodes as resonators (i.e., a so-called stripline filter). For such multilayer ceramic filters, reference should be made, for example, to PCT WO 96/19843 and Japanese Patent Application Laid-Open No. 312503/95. A multilayer ceramic filter of this type is advantageous in that since the dielectric constant of the ceramic material used therein is high the effective wavelength of the signal becomes shorter, so that the required length of its resonators can be shorter. As a result, the size of the filter can be reduced and the insertion loss is relatively low.

The manufacturing cost of a dielectric filter of the above-described type which uses a dielectric material of a high dielectric constant is determined mainly by the cost of the dielectric material. Therefore, in order to reduce the manufacturing cost of a dielectric filter of this type, it may be considered that the size of the filter is further decreased to thereby reduce the amount of the dielectric material used. However, since the size of the filter itself directly relates to its frequency characteristic (particularly, its centre frequency), the reduction of cost by decreasing the filter size is limited.

It may further be considered as another way of reducing the manufacturing cost of a dielectric filter of this type that the cost of the dielectric material itself is lowered. However, since principal characteristics of a filter such as a cut-off characteristic and insertion loss are determined by the dielectric material used, it is necessary for the manufacture of a filter to use a dielectric material whose dielectric constant and dielectric loss have accurately been adjusted or controlled. Consequently, the reduction of the manufacturing cost by this approach is also limited.

SUMMARY OF THE INVENTION

It is therefore an object of the present invention to provide a miniature dielectric filter which can be manufactured at reduced cost.

It is another object of the present invention to provide a dielectric filter which has a lower insertion loss in the pass band.

It is a further object of the present invention to provide a dielectric filter which exhibits a better attenuation in the cut-off band.

It is a still further object of the present invention to provide a dielectric filter which is electromagnetically less affected by the surroundings.

In order to achieve the above objects, according to the present invention, a dielectric filter comprising a first dielectric layer, which contains at least a pair of strip-line resonators to be electro-magnetically coupled to each other, and second and third dielectric layers, which are disposed in an opposed relation to each other with the first dielectric layer sandwiched therebetween, have substantially the same dielectric constant K1 and each contains at least one shield electrode, is characterized in that fourth and fifth dielectric layers having substantially the same dielectric constant K2 are interposed between the first and second dielectric layers and between the first and third dielectric layers, respectively, and in that the dielectric constant K2 of the fourth and fifth dielectric layers is selected to be less than any one of the dielectric constant K1 of the second and third dielectric layers and the dielectric constant K3 of the first dielectric layer. In this case, the dielectric constant K2 should preferably be less than at least one third of the smaller one of the dielectric constants K1 and K3.

The dielectric filter of the above-described structure can be manufactured at lower cost by forming the fourth and fifth layers with a cheap dielectric material of a low dielectric constant such as a ceramic material containing glass to a large extent, a lacquer or the like, as compared to the conventional filter in which all the dielectric layers are formed with expensive dielectric materials of high dielectric constant. It should be noted that the use of dielectric layers of high and low dielectric constants to form a dielectric filter has been known from Japanese Patent Application Laid-Open No. 214204/97. However, the dielectric layer of lower dielectric constant of such known dielectric filter is not interposed between the dielectric layers of higher dielectric constant. In the present invention, although the relationship between the dielectric constants K1 and K3 may be any of K1=K3, K1>K3 and K1<K3, the relation K1=K3 is most preferred since the number of kinds of materials to be used is low. In this case, in certain filters for specific purposes, the dielectric constants K1 and K3 may typically be selected to be in the range from 70 to 100 and the dielectric constant K2 may typically be selected to be in the range from 5 to 25.

In the dielectric filter of the above structure according to the present invention, the fourth and fifth dielectric layers of the dielectric constant K2 which is lower than that of the first dielectric layer are disposed outwardly of the first dielectric layer having the dielectric constant K3 and containing the resonator electrodes, so that the electric field around the resonator electrodes more concentrates in the first dielectric layer, particularly between both resonator electrodes, as compared to the case where the fourth and fifth dielectric layers have high dielectric constant. In this case, the lower the dielectric constant K2 is as compared to the dielectric constant K3, the more the electric field concentrates in the first dielectric layer. As a result of such concentration, the electric field between both resonator electrodes becomes more straight, that is to say, there will be less electric field which is curved outwardly of edges of the resonator electrodes. Consequently, the electric field between the resonator electrodes is more evenly distributed without partially concentrating at edge portions of these electrodes, so that the conduction loss usually caused by such partial concentration of electric field at the edges of the electrodes is reduced, whereby the insertion loss of this filter in the pass band is decreased. For the same reason, the Q value of this filter is improved and the attenuation in the cut-off band is increased.

In the dielectric filter of the above structure, the dielectric constant K1 of the second and third dielectric layers is also selected to be greater than the dielectric constant K2 of the fourth and fifth dielectric layers which are adjacent thereto. As a result, the electric field around the shield electrodes are prevented from spreading further beyond edges of the shield electrodes, i.e., from spreading beyond the sides of this filter, so that the characteristic of this filter is less sensitive to electromagnetic effects in the outer area of the sides.

In the dielectric filter according to the invention, the pair of strip-line resonator electrodes may be provided on different planes within the first dielectric layer which are parallel to each other and spaced in a direction of thickness of the layer. Alternatively, the pair of strip-line resonators may be arranged in a spaced relation on a single plane which is located within and parallel to the first dielectric layer. Furthermore, in the filter according to the invention the first dielectric layer may further comprise capacitance electrodes capacitively coupled to the pair of strip-line resonators, respectively, and/or a tuning electrode for adjusting electromagnetic coupling between the pair of strip-line resonators.

DETAILED DESCRIPTION OF THE PREFERRED EMBODIMENTS

Description will now be made on dielectric filters according to embodiments of the invention with reference to the accompanying drawings.

Figure 1:
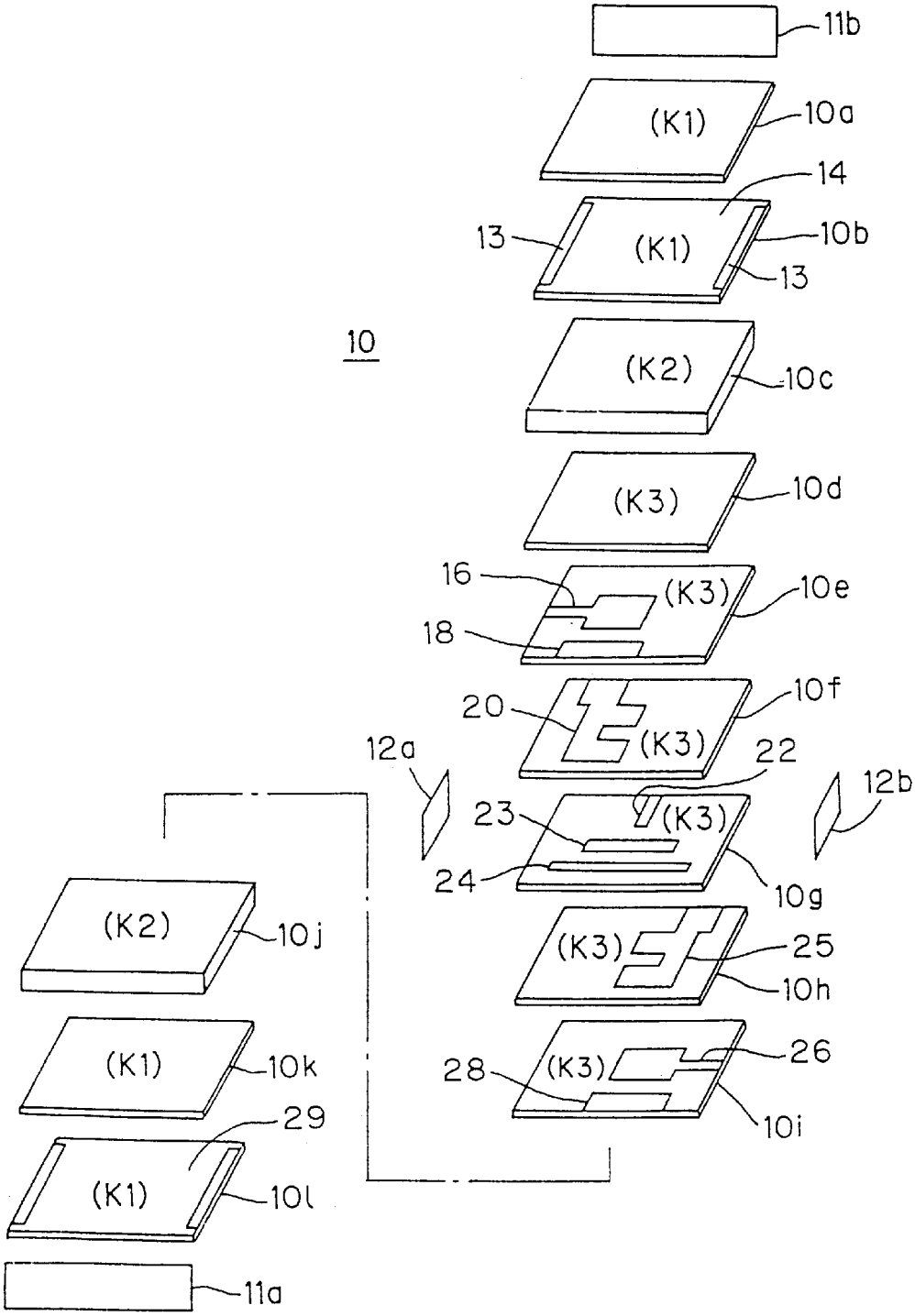
FIG. 1 is an exploded perspective view of a dielectric filter according to a first embodiment of the invention.

FIG. 1 shows a dielectric filter 10 provided according to a first embodiment of the present invention. This filter 10 is a block-type (or a chip-type) filter which comprises twelve dielectric layers 10*a* to 10*l* each having a respective predetermined thickness and a rectangular top view. The filter 10 is provided on a pair of sides thereof (the front and rear sides in FIG. 1) with ground terminal electrodes 11*a* and 11*b*, respectively, which entirely cover surfaces of the corresponding sides. The filter 10 is further provided on the other pair of sides (the right and left sides in FIG. 1) with input/output terminal electrodes 12*a* and 12*b*, respectively, each of which has a strip-like shape and extends in the central portion of the corresponding side in the direction of thickness of the filter 10.

The dielectric layer 10*a* disposed on the side of one surface of this filter (the top surface in FIG. 1) is provided for the purpose of protection. The dielectric layer 10*a* adjoins the dielectric layer 10*b* which is provided on a surface facing the dielectric layer 10*a* with a shield electrode 14 which entirely covers the surface except for its marginal portions 13 extending with predetermined widths along opposite sides of the surface (shorter sides in FIG. 1), the shield electrode 14 being connected to the electrodes 11*a* and 11*b* at the other opposite sides of the surface. The marginal portions 13 are provided for preventing the shield electrode 14 from short-circuiting with the electrodes 12*a* and 12*b*.

On the side of the dielectric layer 10*b* opposite to the dielectric layer 10*a*, the dielectric layers 10*c* and 10*d* are provided in this order. The dielectric layer 10*d* adjoins the dielectric layer 10*e* which is provided on a surface facing the dielectric layer 10*d* with an input electrode 16 which is connected at its proximal end to the electrode 12*a* and has a distal half of an increased width. The dielectric layer 10*e* is further provided on the above-described surface with a strip-like capacitance electrode 18 which is connected to the electrode 11*a*.

The dielectric layer 10*e* adjoins the dielectric layer 10*f* which is provided on a surface facing the dielectric layer 10*e* with a resonator electrode 20 which serves as a first strip-line resonator. This resonator electrode 20 is connected at its proximal end to the electrode 11*b* and forms a modified stepped impedance resonator (SIR) having generally an inverted F shape. The electrode 20 is disposed near the electrode 12*a* so that it is electromagnetically coupled with the input electrode 16 and capacitively coupled with the capacitance electrode 18.

The dielectric layer 10*f* adjoins the dielectric layer 10*g* which is provided on a surface facing the dielectric layer 10*f* with a strip-like first tuning electrode 22 connected at its proximal end to the electrode 11*b*, and with second and third tuning electrodes 23 and 24 which are both in floating states and disposed away from a distal end of the electrode 22 in parallel with the electrode 11*a*.

The dielectric layer 10*g* adjoins the dielectric layer 10*h* which is provided on a surface facing the dielectric layer 10*g* with a resonator electrode 25 which corresponds to the electrode 20 on the layer 10*f* and is disposed, as viewed in FIG. 1, in a laterally symmetrical relation to the electrode 20. The dielectric layer 10*h* adjoins the dielectric layer 10*i* which is provided on a surface facing the dielectric layer 10*h* with an output electrode 26 and a capacitance electrode 28 which correspond to the electrodes 16 and 18 and are disposed in laterally symmetrical relations to the electrodes 16 and 18, respectively.

On the side of the dielectric layer 10*i* away from the layer 10*h*, dielectric layers 10*j* and 10*k* are provided in this order. The latter layer 10*k* adjoins the dielectric layer 10*l* which is provided on a surface facing the layer 10*k* with a shield electrode 29 similar to the electrode 14. This layer 10*l* is provided for the purpose of protection of the other surface (the bottom surface in FIG. 1) of the filter 10.

In the filter 10 of the above structure, each of the layers 10*a*, 10*b*, 10*k* and 10*l* is a dielectric layer having a dielectric constant of K1 which includes as its basis material a ceramic material of a high dielectric constant such as barium titanate. On the other hand, each of the layers 10*c* and 10*j* is a dielectric layer having a dielectric constant of K2 which is made, for example, of a cheap ceramic material of low dielectric constant, which contains glass or the like to a large extent, or a lacquer. Each of the layers 10*d* to 10*i* is a dielectric layer having a dielectric constant of K3 which contains as its basis material a ceramic material of a high dielectric constant such as barium titanate.

EXAMPLE

Conductive paste containing silver as its main component was applied, by means of silk screening, onto green sheets made of a ceramic material having a high dielectric constant, the material having a dielectric constant equal to 75 (K3=75) and containing barium titanate as its basis material. The paste on the green sheets was dried, whereby the electrodes 14; 16 and 18; 20; 22; 23 and 24; 25; 26 and 28 were formed. The green sheets with the electrodes thus formed thereon were combined with a predetermined number of green sheets without electrodes to form a respective one of the dielectric layers 10*a* to 10*l*. These dielectric layers were laminated and then simultaneously pressed and heated in a single sintering process, whereafter the electrodes 11*a*, 11*b*, 12*a* and 12*b* were formed on the respective sides to obtain a sample A for comparison. The thickness of the part consisting of the layers 10*a* and 10*b* was 100 μm, that of the layer 10*c* 400μm, that of the part consisting of the layers 10*d* to 10*i* 700 μm, that of the layer 10*j* 400 μm and that of the part consisting of the layers 10*k* and 10*l* 100 μm.

A sample B for comparison was made in the similar process except that the dielectric layers 10*c* and 10*j* were prepared using green sheets made of a dielectric material of barium titanate and containing as an additive about 20% by weight of glass, this green sheets having a dielectric constant of 50 (K2=50). Furthermore, a sample C was made in the similar manner except that the dielectric layers 10*c* and 10*j* were prepared using green sheets made of a dielectric material of barium titanate and containing as an additive about 60% by weight of glass, this green sheets having a dielectric constant of 15 (K2=15).

Figure 2:
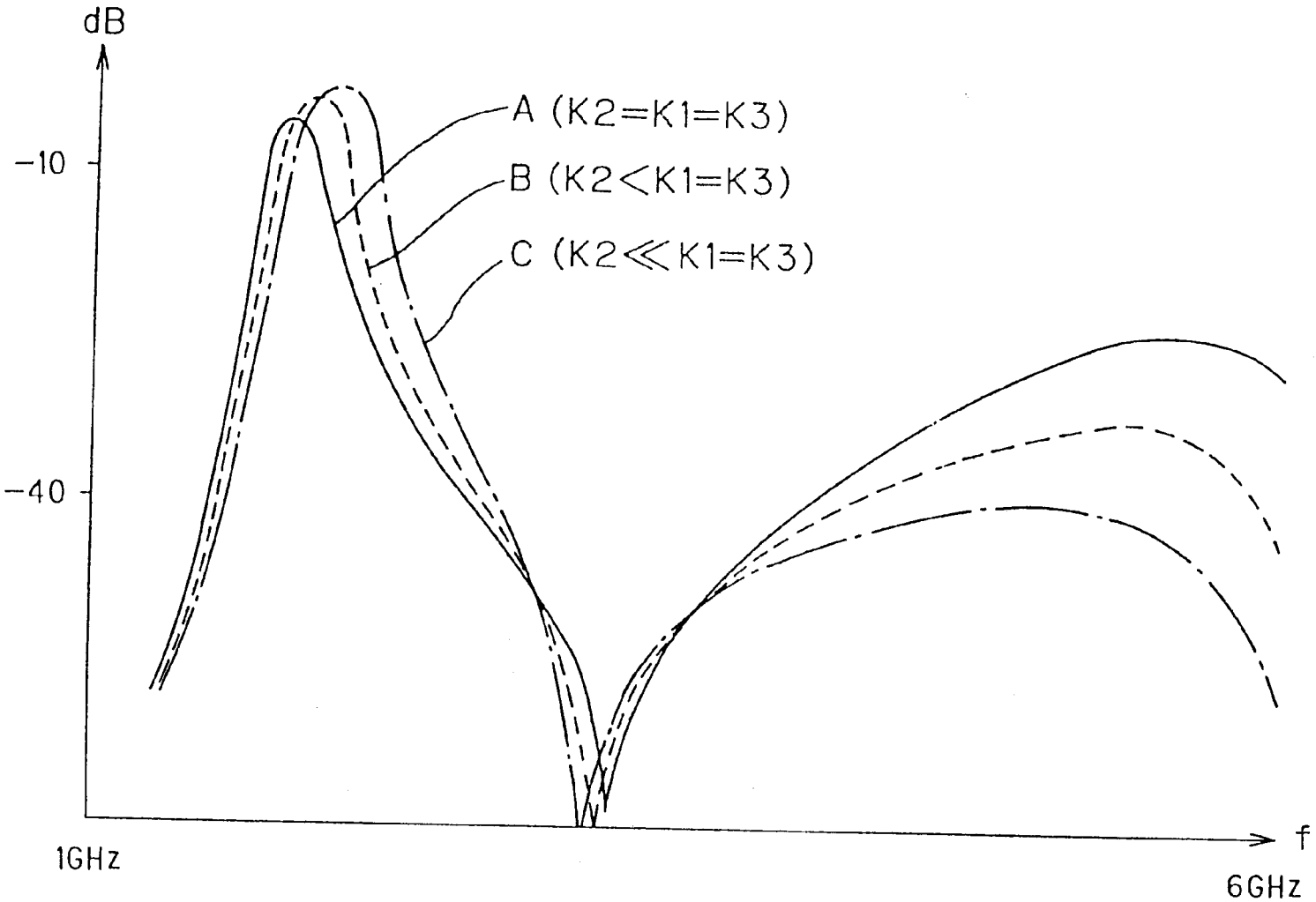
FIG. 2 is a graph showing frequency characteristics of a sample provided according to the first embodiment and another sample for comparison.

The frequency characteristic of each of the samples A, B and C was measured, the results of which are shown in FIG. 2. In FIG. 2, the horizontal axis represents the frequency of the input signal and the vertical axis represents the insertion loss. The solid line A represents the frequency characteristic of the sample A, the broken line B that of the sample B, and the dot-and-dash line C that of the sample C. It is seen from the characteristics shown in FIG. 2 that the sample C prepared according to the present invention has better characteristic, i.e., a reduced insertion loss in the pass band, a larger attenuation in the cut-off band and a higher Q value, than the sample A (which corresponds to the conventional filter) and the sample B. As a result of thorough reviewing and examining the characteristics shown in FIG. 2, characteristics of other samples, the costs of ceramic materials used and so on collectively, it was found that the dielectric constants K1 and K3 should preferably be in the range from 70 to 100 and that the dielectric constant K2 should preferably be in the range from 5 to 25.

Figure 3:
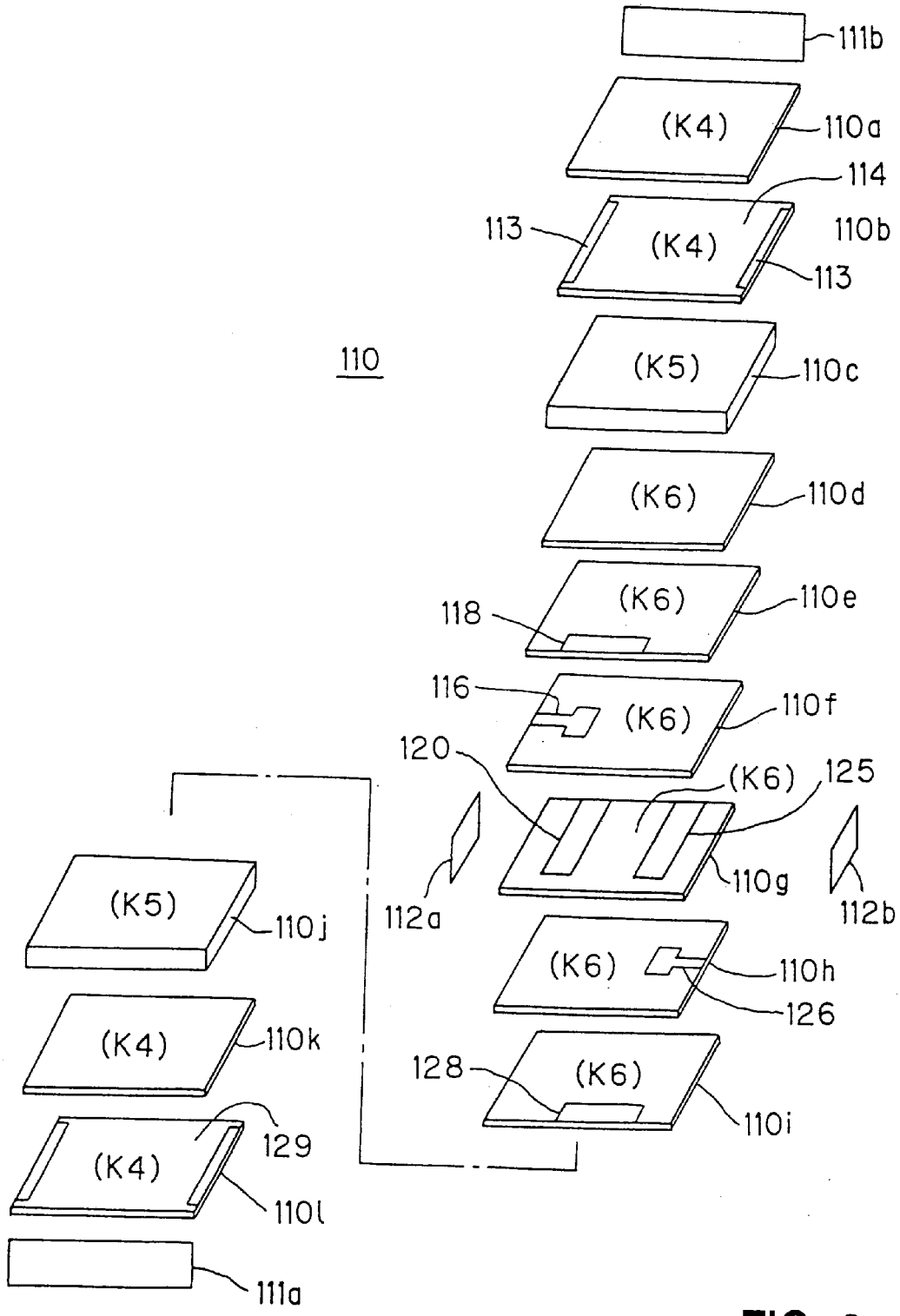
FIG. 3 is an exploded perspective view of a dielectric filter according to a second embodiment of the invention.

FIG. 3 shows a dielectric filter 110 according to a second embodiment of the invention, wherein parts thereof corresponding to those shown in FIG. 1 are designated by like reference numbers but increased by 100. This filter 110 is a block type (or a chip type) filter having substantially the same structure as the filter 10 of FIG. 1 but is different therefrom in the following respects.

A dielectric layer 110*e* of this filter 110 is provided on a surface facing a layer 110*d* only with a strip-like capacitance electrode 118 which is connected to a ground terminal electrode 111*a*. A dielectric layer 110*f* is provided on its surface facing the layer 110*e* only with an input electrode 116. A dielectric layer 110*g* is provided on its surface facing the layer 110*f* with two strip-line resonator electrodes 120 and 125 which are arranged in parallel with a predetermined distance therebetween and connected at their proximal ends to a ground terminal electrode 111*b*. A dielectric layer 110*h* is provided on a surface facing the layer 110*g* with an output electrode 126 which corresponds to the electrode 116 on the layer 110*f* and is arranged, as viewed in FIG. 3, laterally symmetrically with the electrode 116. In a similar manner, a dielectric layer 110*i* is provided on a surface facing the layer 110*h* with a capacitance electrode 128 which corresponds to the capacitance electrode 118 on the layer 110*e* and is arranged, as viewed in FIG. 3, laterally symmetrically with the capacitance electrode 118.

In the filter 110 of the above structure, each of the layers 110*a*, 110*b*, 110*k* and 110*l* is a dielectric layer having a dielectric constant of K4 which includes as its basis material a ceramic material of a relatively high dielectric constant, for example. On the other hand, each of the layers 110*c* and 110*j* is a dielectric layer having a dielectric constant of K5 which is made, for example, of a cheep ceramic material of low dielectric constant, which contains glass or the like to a large extent, or a lacquer, for example. Each of the layers 110*d* to 110*i* is a dielectric layer having a dielectric constant of K6 which contains as its basis material a ceramic material of a high dielectric constant, for example. In this case, the dielectric constant K4 is lower than the dielectric constant K6 and the dielectric constant K5 is significantly lower than any of the dielectric constants K4 and K6.

It was found that the embodiment of FIG. 3 also exhibits substantially the same effects as those obtained by the embodiment of FIG. 1.

The thickness of each dielectric layer of a dielectric filter for a specific purpose such as those described above in relation to the first and second embodiments varies depending upon, among other things, dielectric materials used and shapes of electrodes provided thereon. However, it is generally considered that the thickness of the portion consisting of the dielectric layers 10*a* (110*a*) and 10*b* (110*b*) may be in the range of from 50 to 120 μm, that of the dielectric layer 10*c* (110*c*) in the range of from 200 to 400 μm, that of the part consisting of the dielectric layers 10*d* (110*d*) to 10*i* (110*i*) in the range of from 50 to 700 μm, that of the dielectric layer 10*j* (110*j*) in the range of from 200 to 400 μm, and that of the part consisting of the dielectric layers 10*k* (110*k*) and 10*l* (110*l*) in the range of from 50 to 120 μm.

In the above first and second embodiments, when the dielectric layers 10*c* (110*c*) and 10*j* (110*j*) are made of lacquer or the like having a low dielectric constant K2 (or K5), it will be necessary to first separately form by sintering the part consisting of the dielectric layers 10*a* and 10*b* (or 110*a* and 110*b*) of dielectric constant K1 (or K4), the part consisting of the dielectric layers 10*k* and 10*l* (or 110*k* and 110*l*) of dielectric constant K1 (or K4) and the part consisting of the dielectric layers 10*d* to 10*i* (or 110*d* to 110*i*) of dielectric constant K3 (or K6) and then to laminate these sintered parts with the lacquer layers into an integral component.

What is claimed is:

1. A dielectric filter comprising:

a first dielectric layer containing at least a pair of strip-line resonators to be electro-magnetically coupled to each;

second and third dielectric layers disposed in an opposed relation to each other, wherein the first dielectric layer is sandwiched between the second and third dielectric layers, the second and third dielectric layers having substantially same dielectric constant (K1), each of the second and third dielectric layers containing at least one shield electrode; and fourth and fifth dielectric layers having substantially similar dielectric constant (K2) and being interposed between the first and second dielectric layers and between the first and third dielectric layers, respectively;

wherein the dielectric constant (K2) of said fourth and fifth dielectric layers is selected to be less than any one of the dielectric constant (K1) of said second and third dielectric layers and a dielectric constant (K3) of said first dielectric layer.

2. A dielectric filter according to claim 1, wherein said dielectric constant (K2) of said fourth and fifth dielectric layers is less than one third of a smaller one of the dielectric constants (K1) and (K3) of said second, third and first dielectric layers.

3. A dielectric filter according to claim 1, wherein the dielectric constant (K1) of said second and third dielectric layers is substantially same as the dielectric constant (K3) of said first dielectric layer.

4. A dielectric filter according to claim 1, wherein the dielectric constant (K1) of said second and third dielectric layers is less than the dielectric constant (K3) of said first dielectric layer.

5. A dielectric filter according to claim 1, wherein the dielectric constant (K1) of said second and third dielectric layers is greater than the dielectric constant (K3) of said first dielectric layer.

6. A dielectric filter according to claim 1, wherein said pair of strip-line resonators are located on respective planes within said first dielectric layer, and wherein said planes are parallel and spaced in a direction of thickness of said first dielectric layer.

7. A dielectric filter according to claim 1, wherein said pair of strip-line resonators are disposed in a spaced relation on a single plane within said first dielectric layer, said plane extending parallel to said first dielectric layer.

8. A dielectric filter according to claim 1, wherein said first dielectric layer further comprises capacitance electrodes capacitively coupled to the pair of strip-line resonators, respectively, and/or a tuning electrode for adjusting an electro-magnetic coupling between said pair of strip-line resonators.

9. A dielectric filter according to claim 1, wherein said fourth and fifth dielectric layers comprise a dielectric material of low dielectric constant which contains glass.

10. A dielectric filter according to claim 1, wherein said fourth and fifth dielectric layers comprise a dielectric material of low dielectric constant which contains lacquer as a basis material.

11. A dielectric filter according to claim 1, wherein said fourth and fifth dielectric layers do not include a transmission line connected to an input of said dielectric filter.

12. A dielectric filter comprising:

a first dielectric layer containing a resonator and having a first dielectric constant;

a second dielectric layer and a third dielectric layer each containing an electrode and having a second dielectric constant, said first dielectric layer being sandwiched between said second dielectric layer and said third dielectric layer; and a fourth dielectric layer and a fifth dielectric layer each having a third dielectric constant, said fourth dielectric layer being interposed between said first dielectric layer and said second dielectric layer, and said fifth dielectric layer being interposed between said first dielectric layer and said third dielectric layer;

wherein the third dielectric constant is less than any one of said second dielectric constant and said first dielectric constant.

13. The dielectric filter of claim 12, wherein said fourth dielectric layer and said fifth dielectric layer do not include a transmission line connected to an input of said dielectric filter.

14. The dielectric filter of claim 12, wherein said third dielectric constant is less than one third of a smaller one of said first dielectric constant and said second dielectric constant.

15. The dielectric filter of claim 12, wherein said second dielectric constant is one of being substantially equal to, less then, and greater then said first dielectric constant.

* * * * *

UNITED STATES PATENT AND TRADEMARK OFFICE

CERTIFICATE OF CORRECTION

PATENT NO. : 6,222,430 B1
DATED : April 24, 2001
INVENTOR(S) : Kenichi Horie and Shoichi Iwaya It is certified that error appears in the above-identified patent and that said Letters Patent is hereby corrected as shown below:

Column 6,
Line 41, after "each", insert -- other --.

Signed and Sealed this

Eleventh Day of June, 2002

*Attest:*

*Attesting Officer*

JAMES E. ROGAN
*Director of the United States Patent and Trademark Office*